US007497219B2

(12) United States Patent
Gueret

(10) Patent No.: US 7,497,219 B2
(45) Date of Patent: Mar. 3, 2009

(54) DEVICE AND METHOD FOR APPLYING A SUBSTANCE TO KERATINOUS FIBERS

(75) Inventor: J an-Louis H. Gueret, Paris (FR)

(73) Assignee: L'Oréal S.A., Paris (FR)

( * ) Notice: Subject to any disclaimer, the term of this patent is extended or adjusted under 35 U.S.C. 154(b) by 1048 days.

(21) Appl. No.: 10/367,751

(22) Filed: Feb. 19, 2003

(65) Prior Publication Data

US 2003/0178043 A1 Sep. 25, 2003

Related U.S. Application Data

(60) Provisional application No. 60/363,088, filed on Mar. 12, 2002.

(30) Foreign Application Priority Data

Feb. 19, 2002 (FR) ..... 02 02076

(51) Int. Cl.
*A45D 40/26* (2006.01)

(52) U.S. Cl. ..... 132/218; 132/200

(58) Field of Classification Search ..... 132/218, 132/156, 154, 148, 308–311; 15/201, 167.1; 401/122–129

See application file for complete search history.

(56) References Cited

U.S. PATENT DOCUMENTS 52,833 A * 2/1866 Eagle ..... 15/201
1,860,924 A * 5/1932 Cooke ..... 15/167.1
1,928,328 A * 9/1933 Carpentier ..... 15/167.1
1,962,337 A * 6/1934 Youngstrom ..... 132/308
2,003,243 A * 5/1935 Campbell et al. ..... 15/167.1
2,254,365 A * 9/1941 Griffith et al. ..... 15/167.1
2,267,625 A * 12/1941 Wulfson ..... 132/308
2,676,350 A * 4/1954 Bressler ..... 15/167.1
2,796,620 A * 6/1957 Bressler ..... 15/201

(Continued)

FOREIGN PATENT DOCUMENTS

EP 1 155 637 11/2001

(Continued)

OTHER PUBLICATIONS

English language Derwent Abstract of EP 1 155 637, Nov. 21, 2001.

(Continued)

*Primary Examiner*—Robyn Doan
(74) *Attorney, Agent, or Firm*—Finnegan, Henderson, Farabow, Garrett & Dunner, L.L.P.

(57) ABSTRACT

A device for applying a substance to keratinous fibers may include a cake of substance and an applicator. The applicator may include a handle member defining a longitudinal axis and an applicator element. The applicator element may include a support having a first end and a second end opposite the first end. The first end may be closer to the handle member than the second end. The applicator element may include a plurality of bristles extending from at least one side of the support between the first end and the second end. The support may be configured to be flexed so as to deform about at least one axis that is substantially perpendicular to the longitudinal axis of the handle member.

18 Claims, 6 Drawing Sheets

U.S. PATENT DOCUMENTS

| | | | | | |
|---|---|---|---|---|---|
| 3,253,292 | A | * | 5/1966 | Herschensohn | 15/201 |
| 4,898,195 | A | | 2/1990 | Sussman | |
| 5,002,415 | A | * | 3/1991 | Gueret | 401/126 |
| 5,137,038 | A | | 8/1992 | Kingsford | |
| 5,500,975 | A | * | 3/1996 | Sano | 15/167.1 |
| 5,816,728 | A | * | 10/1998 | Nardolillo et al. | 401/126 |
| 6,073,634 | A | * | 6/2000 | Gueret | 132/218 |
| 2003/0183240 | A1 | | 10/2003 | Manougian et al. | |

FOREIGN PATENT DOCUMENTS

| | | |
|---|---|---|
| FR | 2 759 872 | 8/1998 |
| WO | WO 92/11785 | 7/1992 |

OTHER PUBLICATIONS

English language Derwent Abstract of FR 2 759 872, Aug. 28, 1998.

* cited by examiner

DEVICE AND METHOD FOR APPLYING A SUBSTANCE TO KERATINOUS FIBERS

This application claims the benefit of priority under 35 U.S.C. § 119(e) of U.S. provisional application No. 60/363,088, filed Mar. 12, 2002.

The present invention relates to a device and method for applying a substance to keratinous fibers, for example, eyelashes and/or eyebrows. For example, the invention relates to applying a substance taken from a cake of substance, for example, a cake of mascara.

In the field of devices and methods for applying a substance, devices may include a box capable of housing a cake of substance along with an applicator that may include a brush having bristles that extend from a rigid support. International application WO 92/11785 discloses a mascara brush designed to be loaded with substance by being inserted into a receptacle containing the substance, wherein the brush has a shape that can be modified by acting on a control member. Japanese utility model no. 014169/1983 discloses a device for packaging and applying mascara. The device includes an applicator having an applicator element capable of being loaded with substance by being immersed in a receptacle having a wiper and containing the substance. The applicator element comprises a support having one face covered in bristles. The support is made integrally with a rod capable of being moved along an axis of the applicator. The support can be caused to bend to a greater or lesser extent by being pressed against a rigid surface of the applicator. Application FR-A-2 759 872 discloses an applicator having a handle to which a bristle-supporting support is connected via a film hinge. The support can pivot about an axis perpendicular to the longitudinal axis of the handle. That application also describes an applicator including a flexible handle enabling the user to give it a slightly curved shape during application so as to match substantially the curvature of the arc of eyelashes.

There exists a need for a device including a cake of substance along with an applicator for enabling the substance to be more easily loaded onto an applicator, for example, when the cake of substance becomes worn and its surface has a shape that is different from its initial shape, for example, a dished shape (e.g., a concave shape).

There also exists a need to enable an applicator to be loaded in a relatively uniform manner with a substance taken from a cake of substance.

There also exists a need for an applicator that can be loaded with substance using a cake of substance that has a particular shape, and where appropriate, that is capable of adapting to the shape of the eyelashes and/or eyebrows and/or that is capable of implementing new makeup effects.

Although the present invention may obviate one or more of the above-mentioned needs, it should be understood that some aspects of the invention might not necessarily obviate one or more of those needs.

In the following description, certain aspects and embodiments will become evident. It should be understood that the invention, in its broadest sense, could be practiced without having one or more features of these aspects and embodiments. It should be understood that these aspects and embodiments are merely exemplary.

In one aspect, as embodied and broadly described herein, the invention includes a device for applying a substance to keratinous fibers. The device may include a cake of substance and an applicator. The applicator may include a handle member defining a longitudinal axis and an applicator element including a support. The support may include a first end and a second end opposite the first end, the first end being closer to the handle member than the second end, and a plurality of bristles extending from at least one side of the support between the first end and the second end. The support may be configured to be flexed so as to deform about at least one axis that is substantially perpendicular to the longitudinal axis of the handle member.

According to another aspect, a device for applying a substance to keratinous fibers may include a cake of substance and an applicator. The applicator may include a handle member and an applicator element including a support and a plurality of bristles extending from the support. At least some of the plurality of bristles may have ends defining a shape wherein the support is configured to be flexed in a direction defined by a length of at least some of the bristles such that the shape defined by the ends of at least some of the plurality of bristles changes upon flexing the support (i.e., the flexing of the support causes at least some of the bristles to move with respect to other bristles at least in the direction of their length). For example, the flexibility of the support may enable the relative orientations of the bristles to be modified when the support is deformed.

The support (e.g., flexible support) of the applicator may render it possible, for example, for the applicator element to adapt to the shape of the cake of substance after it has become worn.

According to still another aspect, the applicator may be configured to apply the substance to at least one of eyelashes and eyebrows.

In still a further aspect, the bristles may extend from one side only of the support, or alternatively, they may extend from a plurality of sides of the support. The bristles need not extend all around the support, for example, in order to leave the support with a surface which the user can press with a finger in order to deform the support while taking the substance.

In yet another aspect, the support may include at least two portions and at least one deformation zone between the at least two portions. The at least one deformation zone may include, for example, at least one portion having a reduced cross-section. According to one aspect, the at least one deformation zone may include at least one hinge part integrally molded with the at least two portions. For example, the hinge part may be molded together with the adjacent portions. The hinge part may, for example, form a film hinge. The at least two portions may be of the same length or of different lengths.

According to another aspect, the at least one deformation zone may include at least one hinge part formed of a material differing from a material forming the at least two portions. In addition, the bristles may extend from the at least two portions and the bristles may not extend from the at least one deformation zone.

In still another aspect, the applicator may include a moving element configured to change the shape of the support. This may render it possible, for example, to modify the configuration of the bristles. The moving element may be configured to slide with respect to the support. For example, the moving element may slide on the applicator element or in the applicator element.

According to yet another aspect, the moving element may be configured to change the shape of the support via cooperation with an outside surface of the support. In yet another aspect, the support may include an internal housing having an interior configured to engage with the moving element.

In another aspect, the moving element may include a rectilinear part, for example, a rectilinear part that is more rigid than the support. The cooperation between the moving element and the support may render it possible, for example, for a user to cause the support to pass from a curvilinear configuration which may be natural to the support (e.g., the at-rest position of the support where there is an absence of stress applied to the support) when the moving element is in its retracted position, to a substantially rectilinear configuration when the rectilinear part of the moving element is engaged in the support or on the support. The moving element may alternatively present a curvilinear shape in the absence of stress. Cooperation between the moving element and the support may then make it possible, for example, for the user to cause the support to go from a substantially rectilinear configuration taken up by the support when the moving element is in its retracted position, to a curvilinear configuration when the moving element is engaged in the support or on the support.

According to another aspect, the handle member may define a substantially rectilinear axis. The moving element may be configured to have a substantially rectilinear shape when the moving element is at least one of in the handle member and on the handle member, and the moving element may be configured to have a curvilinear shape when the moving element is at least one of in the support and on the support.

In another aspect, the support may define a substantially constant outside cross-section.

In a further aspect, the applicator may include a handle member having the support connected thereto.

In yet another aspect, the moving element may be elastically deformable, at least in part, and may render it relatively easier to retract the moving element into the handle member.

According to yet another aspect, the moving element may be configured to have shape memory. In addition, the moving element may be configured to move relative to the handle member and the support, and the applicator may be configured such that the shape of the moving element changes when the moving element is moved relative to the handle member and the support.

In still another aspect, the handle member may be elongate along a substantially rectilinear axis. The moving element may take up a shape that is substantially rectilinear when it is in the handle member or on the handle member, and a shape that is curvilinear when it is in the support or on the support (e.g., because of its own elasticity). The handle member may also be elongate along a curvilinear axis.

In yet another aspect, at least a portion of the support may include a substantially elastically deformable material. For example, the material may include a thermoplastic elastomer. In an additional aspect, the support may present at least one part that has shape memory. For example, the entire support may have shape memory.

In an additional aspect, the support may include at least one rigid portion, for example, which may support bristles.

In another aspect, in the absence of stress being exerted by the user and/or by a moving element as discussed above, the applicator element may extend along a longitudinal axis that is substantially rectilinear. Alternatively, the applicator element may extend, at rest, along a longitudinal axis that is not rectilinear, for example, a longitudinal axis that is curvilinear.

In an additional aspect, the support may extend along a substantially rectilinear longitudinal axis when at rest. Alternatively, the support may extend along a substantially non-rectilinear longitudinal axis when at rest. For example, the substantially non-rectilinear longitudinal axis may include a curvilinear axis.

In another aspect, the support may present a face that is concave, planar, or convex adjacent the bristles. Alternatively, the support may present an outside cross-section that is substantially constant.

In yet another aspect, the first end of the support may be connected to the handle member and the first end of the support may be fixed axially relative to the handle member. In another aspect, the support may be connected in an optionally removable manner to the handle member. In yet another aspect, the support may be connected in an optionally hinged manner to the handle member.

In still another aspect, the support may include a plurality of holes and each of the plurality of holes may receive a tuft of the bristles. For example, the holes may open out in a face of the support that has no projecting elements other than the bristles. The disposition of the holes over the support may be selected as a function of the desired makeup effect, of the nature of the bristles used, and/or of the shape of the support. For example, the bristles may not extend from substantially all around the support (e.g., the bristles may extend from substantially only one side of the support). According to one aspect, the plurality of holes may be substantially aligned with one another on the support. According to another aspect, the plurality holes may be arranged in a substantially staggered configuration on the support. In an additional aspect, the holes may be arranged in at least two substantially parallel rows on the support.

According to another aspect, the applicator element may include at least one tuft of the bristles held in a hole of the support via deformation of the hole after the bristles have been inserted therein. The hole may be deformed, for example, by causing the support material to creep (e.g., by stamping the support, the stamping being possibly performed hot or cold). In another aspect, the support may include at least one blind hole and a through hole associated therewith, wherein the at least one blind hole may be configured to receive a tuft of the bristles. The blind hole may be perpendicular to the through hole and may optionally receive a peg for fixing the tuft of bristles in the through hole.

In another aspect, the support may include at least one hole having a cross-section that varies between two ends of the at least one hole, the at least one hole containing a tuft of the bristles. For example, at least some or all of the holes may be formed with a countersinking at one or both ends of the hole. Such countersinking may enable, for example, the bristles to present a substantially fan-shaped configuration upon exit of the support.

In an additional aspect, the support may include bristle-supporting portions and the bristles may be the only elements projecting from the applicator, for example, and may be interconnected by deformation zones that have no bristles. The support may include at least two portions, and the number of the at least two portions may range from 2 to 15 (e.g., the number of the at least two portions may range from 3 to 8).

In another aspect, the support may be substantially free of any projecting elements on a side opposite the at least one side from which the bristles extend. For example, the support may have no projecting elements on a side of the support opposite from the at least one side from which the bristles extend. The support may include, for example, at least a first face provided solely with bristles without projecting elements of a different type and at least a second face provided with projecting elements which are not bristles, for example, teeth may be formed integrally with the support (e.g., via molding). The second face may be substantially opposite the first face.

In an additional aspect, the handle member may define an elongate shape and the applicator element may include a plurality of bristles extending in a direction which is not parallel to the longitudinal axis, for example, substantially perpendicularly to the longitudinal axis of the handle member. The bristles may be fixed, for example, in holes in the support, each of which may have an axis substantially perpendicular to the longitudinal axis of the handle member.

In yet another aspect, each of at least some of the bristles may have a length between the support and a bristle free end of at least about 3.5 millimeters. For example, the length may range from about 8 millimeters to about 15 millimeters.

According to another aspect, the support may include at least one opening. For example, the at least one opening may be located in a center of the support and the support may define an annular shape. In one aspect, the support may define a substantially rectangular shape. In another aspect, the support may define a substantially circular shape.

In yet another aspect, the applicator element may be configured to return to an initial shape when a user no longer applies a deformation force to the applicator element.

In another aspect, the support may be more flexible than the handle member such that the handle member may not flex substantially during the flexing of the support. For example, the handle member may be formed of a relatively rigid material.

In still another aspect, the cake of substance may include a cosmetic product. For example, the cosmetic product may include mascara. In one aspect, before first use, the cake of substance may present an outside surface that is outwardly convex in shape. In a variant, the cake of substance may present, before first use, an outside surface that is substantially planar or even concave in shape. The cake of substance need not contain any solvent (e.g., it may be substantially dry). Under such circumstances, prior to use, a solvent, such as, for example, water and/or saliva, may be deposited on the surface of the cake and/or on the applicator so that at least a portion of the cake can be dispersed. In another aspect, the cake may alternatively include a solvent (e.g., the cake may not be be substantially dry). For example, such an arrangement may permit a portion of the substance to be loaded onto the applicator without using an additional solvent.

In an additional aspect, the device may include a receptacle that may include a first portion configured to receive the cake of substance and a second portion configured to receive the applicator. In another aspect, the applicator may be provided without the cake of substance and/or the receptacle.

In yet another aspect, the applicator may be configured for makeup of keratinous fibers, for example, the eyelashes and/or the eyebrows. The applicator may include a support (e.g., a flexible support) having a face carrying bristles and an opposite face that may be substantially free from any projecting elements, wherein pressure may be exerted on the opposite face, for example, in order to change the shape of the support.

In an additional aspect, a method of applying a substance to keratinous fibers may include providing a cake of substance and an applicator element including a deformable support and a plurality of bristles. The method may include loading the applicator element with a portion of the substance of the cake, changing the shape defined by ends of at least some of the bristles of the applicator element by deforming the deformable support (i.e., the deforming of the support causes at least some of the bristles to move with respect to other bristles at least in the direction of their length), and applying the substance to the keratinous fibers after the shape change. The keratinous fibers may include at least one of eyelashes and eyebrows.

The term "providing" is used in a broad sense, and refers to, but is not limited to, making available for use, enabling usage, giving, supplying, obtaining, getting a hold of, acquiring, purchasing, manufacturing, selling, distributing, possessing, making ready for use, and/or placing in a position ready for use.

In yet another aspect, loading the applicator element may include pressing a finger on the deformable support of the applicator element so as to cause the shape defined by the ends of at least some of the bristles to substantially correspond to the shape of the cake of substance. Changing the shape defined by the ends of at least some of the bristles may occur after the bristles are loaded with substance. The method may include releasing a deformation force applied to the deformable support such that the shape defined by the ends of at least some of the bristles returns elastically to an initial shape. The shape of the applicator, after it has been loaded with substance, may then be optionally modified by releasing the applicator element, and the applicator element may be configured to return to an initial shape (e.g., elastically).

In still another aspect, the applicator element may include a moving element and changing the shape defined by the ends of at least some of the bristles may occur after the applicator element is loaded with substance, for example, by moving the moving element.

According to yet another aspect, a method for applying a substance to keratinous fibers may include providing a device according to at least one aspect described above, loading a portion of the substance onto the applicator element, changing the shape of the support, and applying at least some of the substance to the keratinous fibers.

In an additional aspect, changing the shape of the support may include bending the support. In some examples, the shape changing occurs without deforming a handle member associated with the applicator element.

In still another aspect, the substance may include a cosmetic product. For example, the substance may include mascara and the keratinous fibers may include at least one of eyelashes and eyebrows.

In yet another aspect, a method of applying a substance to keratinous fibers may include providing a device according to at least one of the aspects discussed above, making up the keratinous fibers using the device, changing the shape of the applicator element, and continuing the making up of the keratinous fibers after the shape change. In another aspect, the keratinous fibers may include at least one of eyelashes and eyebrows.

Aside from the structural and procedural arrangements set forth above, the invention could include a number of other arrangements, such as those explained hereinafter. It is to be understood, that both the foregoing description and the following description are exemplary.

The accompanying drawings are incorporated in and constitute a part of this specification. The drawings illustrate exemplary embodiments of the invention and, together with the description, serve to explain some principles of the invention. In the drawings, FIG. 1 is a perspective view of an embodiment of a device for applying a substance to keratinous fibers;

Reference will now be made in detail to some possible embodiments of the invention, examples of which are illustrated in the accompanying drawings. Wherever possible, the same reference numbers are used in the drawings and the description to refer to the same or like parts.

Figure 1:
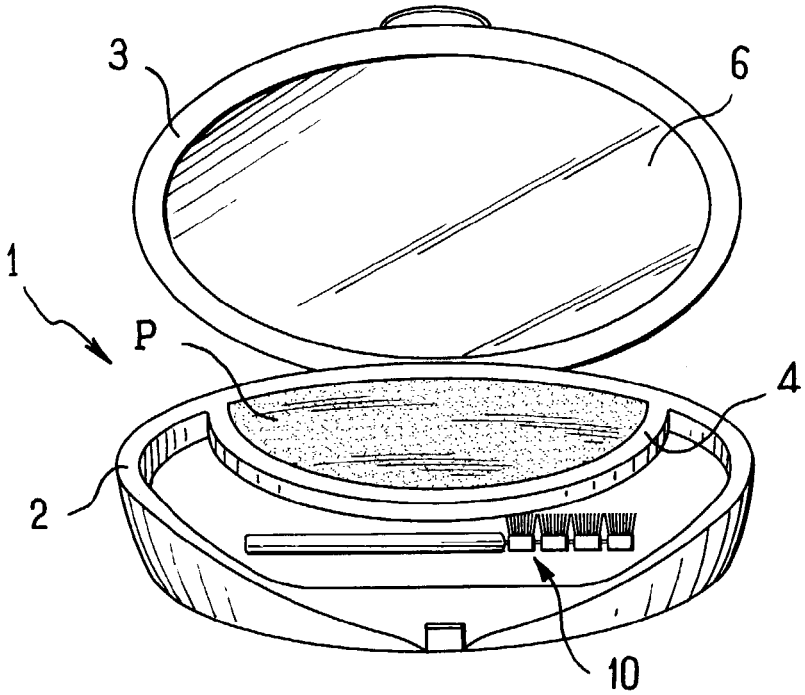

FIG. 1 depicts an exemplary embodiment that may include a receptacle 1 (e.g., a box) that may comprise a body 2 and a lid 3 associated with the body 2 (e.g., via a hinge) in conventional manner. The body 2 may include a partition 4 defining a housing for containing a cake of substance P along with a housing in which one or more applicators 10 may be stowed for use in loading a portion of a substance P from the cake and applying it to, for example, the eyelashes and/or the eyebrows. A mirror 6 may be associated with an inside face of the lid 3, and the lid 3 may be held in the closed position on the receptacle 1 by, for example, a clasp.

Figure 2:
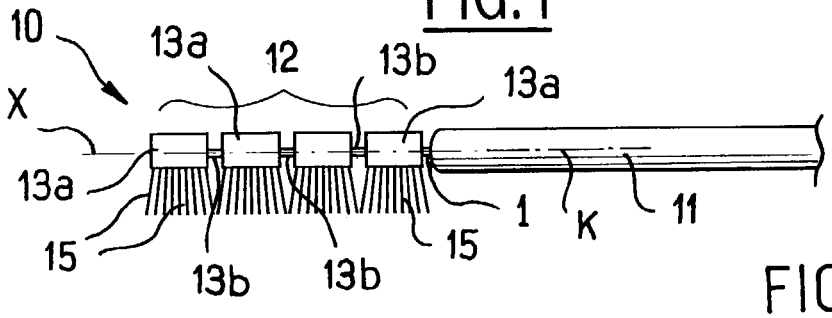
FIG. 2 is a partial schematic view of an embodiment of an applicator of a device for applying a substance to keratinous fibers.

FIG. 2 depicts an exemplary embodiment of an applicator 10 that may include a handle member 11 (e.g., at least partially formed by a substantially rigid stick) including an applicator element 12 that may be fixed to one end thereof. The applicator element 12 may include a support 13 formed from, for example, a plurality of portions 13*a* that may be interconnected (e.g., via hinge parts 13*b*) defining deformation zones. Bristles 15 may extend from substantially the same side of the support 13, for example, as shown in FIG. 2. The bristles 15 may be fixed to the portions 13*a*, and they may, for example, be the only projecting elements for engaging in the eyelashes and/or the eyebrows. The bristles 15 may be natural and/or synthetic (e.g., they may include a nylon and/or one or more other polymers), and they may define a cross-section that may be, for example, substantially circular, although bristles 15 having other cross-sectional shapes may also be used. The bristles 15 may include a material that is different from the material of the support 13.

Figure 3:
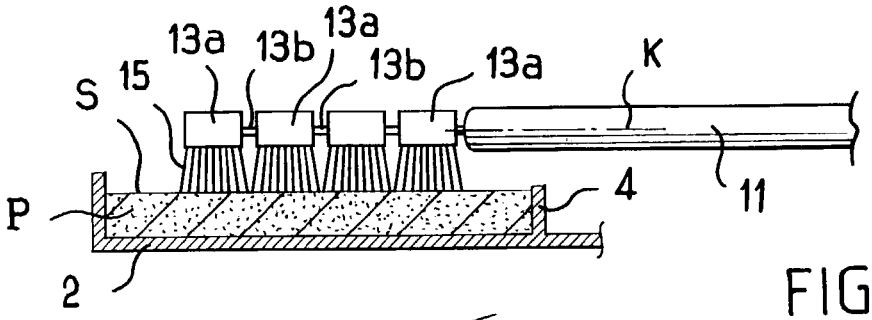
FIG. 3 is a partial schematic view of an embodiment of an applicator of a device for applying a substance to keratinous fibers including a schematic section view of an embodiment of a cake of substance in one configuration.

According to some exemplary embodiments, the support 13 may be substantially rectilinear along an axis X at rest. The axis X may be, for example, substantially parallel to a longitudinal axis K of the handle member 11. A free surface S of the cake of substance P may be, for example, initially substantially planar, as shown in FIG. 3, so that the substance P may be loaded in a substantially uniform manner onto substantially all of the bristles 15 of the applicator element 12 by contacting it with the free surface S.

Figure 4:
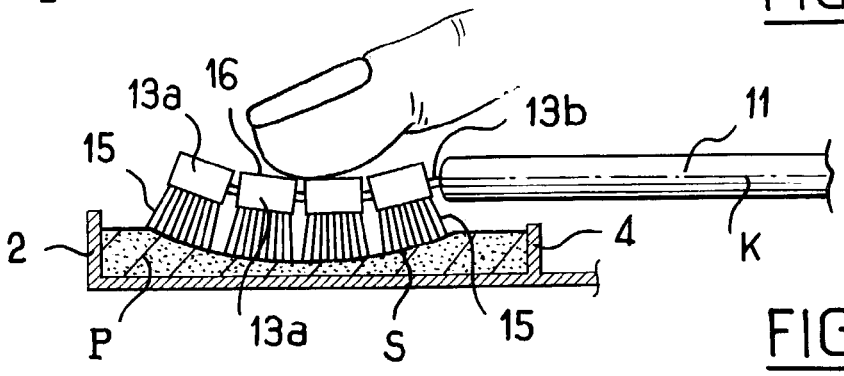
FIG. 4 is a partial schematic view of an embodiment of an applicator of a device for applying a substance to keratinous fibers including a schematic section view of an embodiment of a cake of substance in another configuration.

The applicator element 12 may include one or more hinge parts 13*b*, which enable the user to deform the support 13, if desired, for example, so as to configure it into a shape that accounts for the extent to which the cake of substance P has become worn, for example, as shown in FIG. 4. FIG. 4 depicts a situation in which the user can press on the face 16, for example, of the portions 13*a* to reconfigure the applicator element 12 into substantially the same shape as the free surface S of the cake of substance P. The portions 13*a* may move relative to one another, for example, by a pivoting movement about one or more axes perpendicular to the plane of FIG. 4 and/or to the longitudinal axis K. The applicator element 12 may be adaptable to the surfaces with which it contacts. This may render it relatively easier to load the bristles 15 of the applicator element 12 with substance P, and/or it may enable the user to continue loading the bristles 15 of the applicator element 12 in a relatively more uniform manner.

Once the substance P has been loaded onto the bristles 15, and once the user releases the pressure exerted on the support 13, the support 13 may be configured to return (e.g., elastically) to its initial shape, as shown in FIG. 2.

The support 13 may possess at least some degree of shape memory by virtue of, for example, the fact that it may be formed of a material that is substantially elastically deformable. Such material may include, for example, a thermoplastic elastomer such as SEBS—sis-polyether blockamide—HYTREL®).

The applicator element 12 may be configured to have many alternative configurations at rest (i.e., in the absence of stress being supplied by the user). For example, FIGS. 5 and 6 depict two exemplary configurations for the applicator element 12 at rest.

Figure 5:
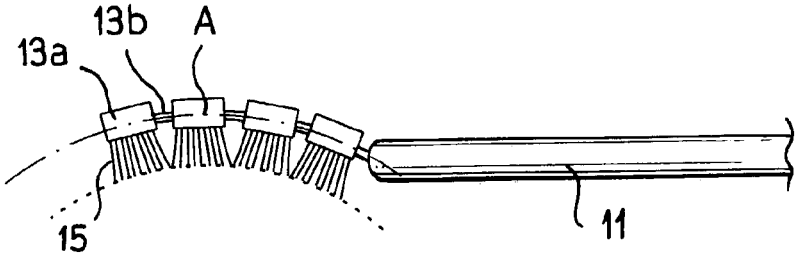
FIG. 5 is a partial schematic view of an embodiment of an applicator of a device for applying a substance to keratinous fibers in one configuration.
Figure 6:
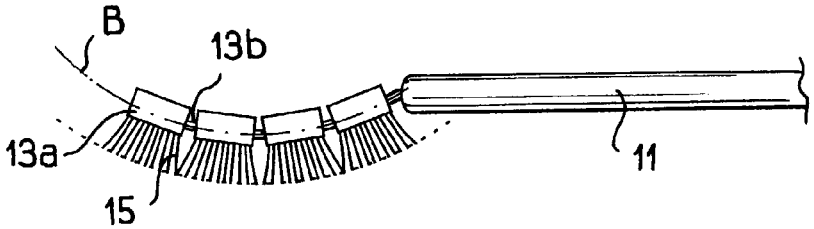
FIG. 6 is a partial schematic view of an embodiment of an applicator of a device for applying a substance to keratinous fibers in another configuration.

FIG. 5 depicts an exemplary embodiment of an applicator element 12 in an at-rest position where the support 13 of the applicator element 12 extends along a line A that is generally concave on the side of the support 13 that includes bristles 15. The exemplary embodiment depicted in FIG. 6, on the other hand, includes a support 13 that extends along a line B that is generally convex on the side of the support 13 that includes bristles 15. Thus, in the exemplary embodiment of FIG. 5, the shape defined by the free ends of at least some of the bristles 15 may be an outwardly concave surface, while in the exemplary embodiment of FIG. 6, the shape defined by the free ends of at least some of the bristles 15 may be an outwardly convex surface.

Figure 7:
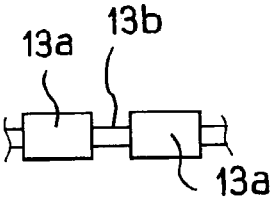
FIG. 7 is a partial schematic view a portion of an embodiment of an applicator of a device for applying a substance to keratinous fibers.
Figure 8:
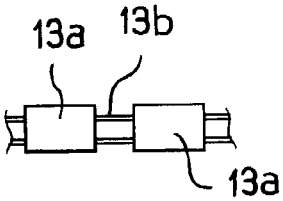
FIG. 8 is a partial schematic view of a portion of another embodiment of an applicator of a device for applying a substance to keratinous fibers.

The hinge parts 13*b* may be formed in various ways. For example, each of the hinge parts 13*b* may include an intermediate portion having a reduced cross-section, as shown in FIG. 7. Such an intermediate portion may be formed integrally with the adjacent portions 13*a* (e.g., by injection molding a plastics material). The hinge parts 13*b* may also include a plurality of bridges of material, as shown in FIG. 8. Such bridges of material may be formed by integrally molding the bridges together with the adjacent portions 13*a*, for example, out of the same material.

Figure 9:
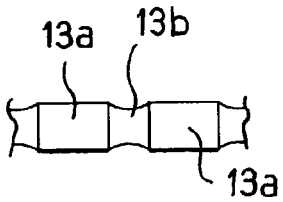
FIG. 9 is a partial schematic view of a portion of a further embodiment of an applicator of a device for applying a substance to keratinous fibers.

As shown in the exemplary embodiment depicted in FIG. 9, the hinge parts 13*b* may also be formed of a material that is different from the material that forms the adjacent portions 13*a*. For example, they may be formed of an elastomer, whereas the portions 13*a* may be formed of, for example, a more rigid plastics material.

The bristles 15 of the applicator element 12 may be fixed to the support 13 in various ways. For example, they can be received in holes 20 in the support 13, and the holes 20 may be arranged in various ways.

Various exemplary arrangements for the holes 20 on the support 13 are depicted in FIGS. 10 through 15.

Figure 10:
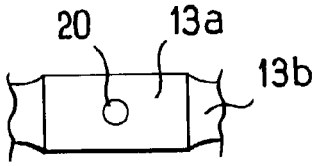
FIG. 10 is a partial schematic view of a portion of another embodiment of an applicator of a device for applying a substance to keratinous fibers.
Figure 11:
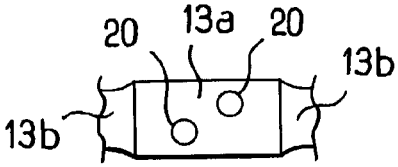
FIG. 11 is a partial schematic view of a portion of a further embodiment of an applicator of a device for applying a substance to keratinous fibers.
Figure 12:
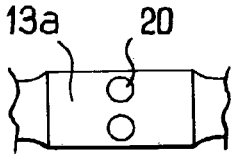
FIG. 12 is a partial schematic view of a portion of another embodiment of an applicator of a device for applying a substance to keratinous fibers.
Figure 13:
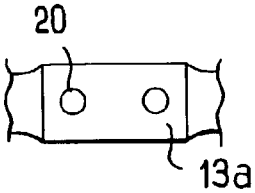
FIG. 13 is a partial schematic view of a portion of a further embodiment of an applicator of a device for applying a substance to keratinous fibers.
Figure 14:
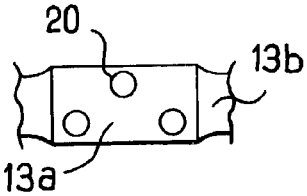
FIG. 14 is a partial schematic view of a portion of another embodiment of an applicator of a device for applying a substance to keratinous fibers.
Figure 15:
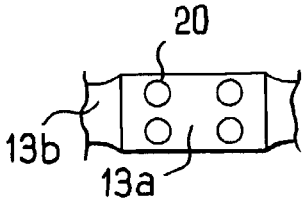
FIG. 15 is a partial schematic view of a portion of a further embodiment of an applicator of a device for applying a substance to keratinous fibers.

Each portion 13*a* may include a single hole 20, for example, serving to receive a single tuft of bristles, as shown in FIG. 10. Alternatively, each portion 13*a* can have a larger number of holes 20, for example, two holes 20, as shown in FIGS. 11 through 13. In another exemplary embodiment, each portion 13*a* may include more than two holes 20, as shown in FIGS. 14 and 15. The holes 20 may be be offset axially and/or laterally on the support 13, for example, as shown in FIG. 11, or they may be arranged in a side-by-side fashion, as shown in FIG. 12. The holes 20 may be substantially aligned with each other, for example, along an axis of the support 13, as shown in FIG. 13. The support 13 may include holes 20 disposed in a staggered configuration, as shown in FIG. 14, or disposed in substantially parallel rows of holes 20, as shown in FIG. 15. The holes 20 may also be arranged in other configurations on the support 13. In addition, at least some of the portions 13*a* may include arrangements of holes 20 that are different from the arrangement of holes 20 on other portions 13*a*.

Figure 16:
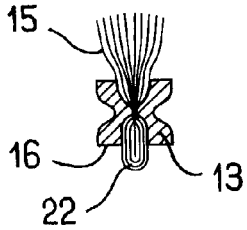
FIG. 16 is a schematic partial section view of a portion of another embodiment of an applicator of a device for applying a substance to keratinous fibers.

The tufts of bristles 15 can be fixed in the holes 20 in various ways. For example, FIG. 16 depicts an exemplary embodiment in which the bristles 15 are fixed in the support 13 by a punching process applied to the material forming the support 13, for example, in a manner similar to that described in European patent application no. EP 1 155 637, the content of which is incorporated herein by reference only to the extent (if any) needed to further understand what is meant by a punching process. Such punching processes enable the material of the support 13 to be deformed in creep.

The holes 20 may be through holes having bristles 15 inserted in the form of bundles folded into a U-shape such that a loop 22 can project beyond the support after a tuft of bristles 15 has been fixed. The loop 22 can either be retained or it can be removed, for example, by shaving the applicator element 12 adjacent to the face 16 of the support 13. In an alternative exemplary embodiment, the bristles 15 may be fixed in tufts by adhesive in the holes 20 of the support 13.

Figure 17:
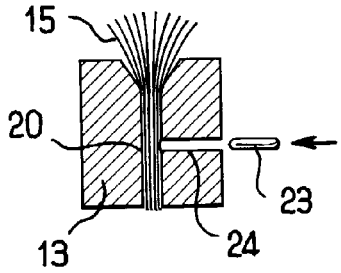
FIG. 17 is a schematic partial section view of a portion of a further embodiment of an applicator of a device for applying a substance to keratinous fibers.

FIG. 17 depicts an exemplary embodiment that includes a tuft of bristles 15 fixed via a peg 23 inserted into a hole 24 associated with the hole 20 and extending along an axis perpendicular thereto. Such a peg 23 may be configured to jam the bundle of bristles 15 inside the support 13.

The bristles 15 may also be fixed to the support 13 by means of one or more staples. For example, a bundle of bristles 15 may be folded into a U-shape and be inserted, for example, into a blind hole of the support 13. The bundle of bristles 15 may be fixed to the bottom thereof via one or more staples inserted into the hole. Bristles 15 may also be fixed by locally melting the support and/or the bristles 15. According to another exemplary embodiment, at least a portion of the support 13 may be overmolded onto the bristles 15.

Figure 18:
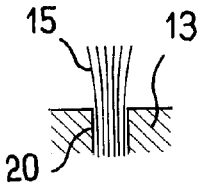
FIG. 18 is a schematic partial section view of a portion of another embodiment of an applicator of a device for applying a substance to keratinous fibers.
Figure 19:
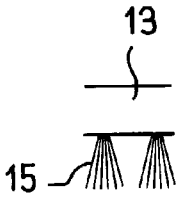
FIG. 19 is a schematic view of a portion of a further embodiment of an applicator of a device for applying a substance to keratinous fibers.
Figure 20:
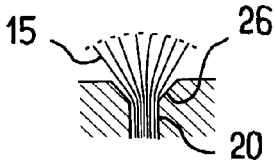
FIG. 20 is a schematic partial section view of a portion of another embodiment of an applicator of a device for applying a substance to keratinous fibers.
Figure 21:
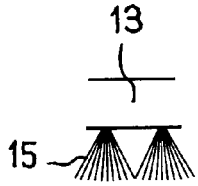
FIG. 21 is a schematic partial section view of a portion of a further embodiment of an applicator of a device for applying a substance to keratinous fibers.

The shape of the hole 20 may be used to affect the shape of the corresponding bundle of bristles 15. For example, FIG. 18 depicts an exemplary embodiment that may include a hole 20 having one end opening out in the form of a substantially circular cylinder. The bundle of bristles 15 may be relatively narrow, thus making it possible, for example, to form separate tufts of bristles 15 on the support 13, as shown in FIG. 19. Alternatively, the end of the hole 20 may have a flared configuration that opens out in a face of the support 13 and the bristles 15 can form a diverging bundle. For example, the flared shape of the hole 20 may be formed by a countersinking 26. In this manner, it may be possible to form tufts of bristles 15 on the support 13 which meet one another, for example, as shown in FIG. 21.

Figure 22:
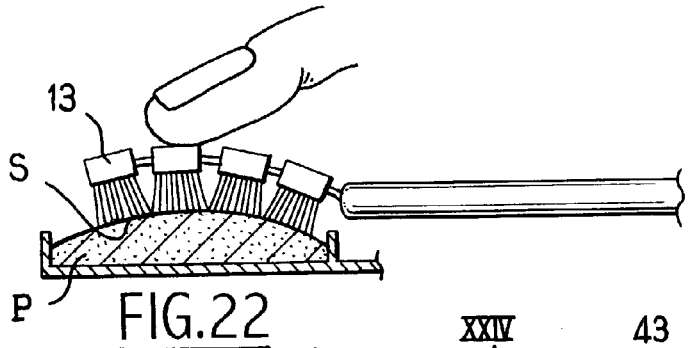
FIG. 22 is a partial schematic view of an embodiment of an applicator of a device for applying a substance to keratinous fibers including a schematic section view of an embodiment of a cake of substance.

The cake of substance P may be formed in a great diversity of initial shapes and the applicator 10 may be configured to be loaded with substance from cakes having those shapes. For example, the cake of substance P may have a free surface that is outwardly convex, as shown in FIG. 22.

According to some exemplary embodiments, the applicator 40 may include a moving element 42 enabling the configuration of the applicator 12 to be changed, for example, between the time when a portion of the substance P is taken from the cake and the time when it is applied to the eyelashes and/or the eyebrows.

Figure 24:
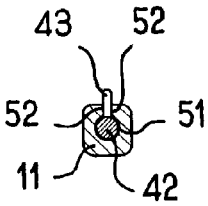
FIG. 24 is a section view along line XXIV-XXIV of FIG. 23.
Figure 23:
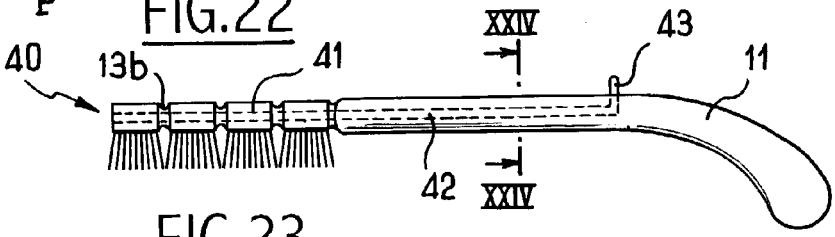
FIG. 23 is a schematic view of an embodiment of an applicator of a device for applying a substance to keratinous fibers.
Figure 25:
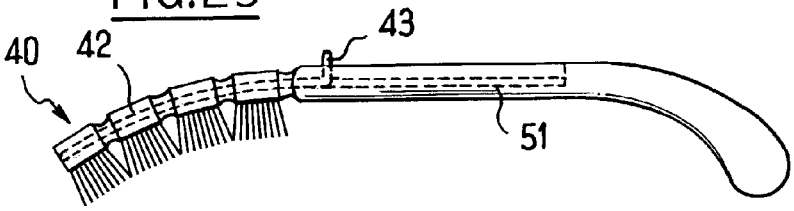
FIG. 25 is a schematic view of the embodiment of applicator of FIG. 23 in another configuration.
Figure 26:
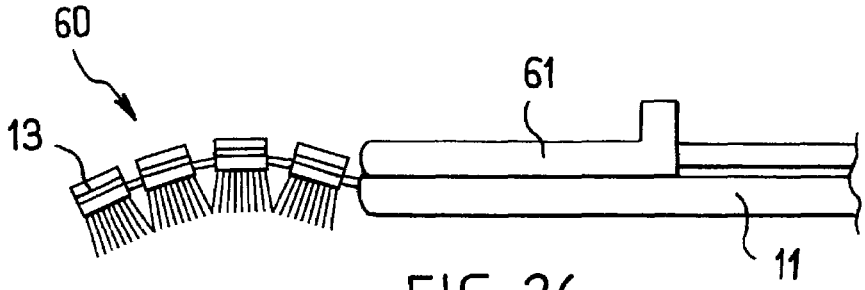
FIG. 26 is a partial schematic view of another embodiment of an applicator of a device for applying a substance to keratinous fibers in one configuration.

For example, FIGS. 23 through 25 depict an exemplary embodiment of an applicator 40 including a support 13 which differs from that described with reference to FIG. 2 by virtue of the fact that it has a longitudinal bore 41 passing therethrough and receiving a moving element 42 in the form of, for example, a rod having a degree of elasticity in bending and having an end remote from the applicator element that is angled so as to form a control finger 43 suitable for being moved by the user to move the moving element 42. The moving element 42 may slide in a groove 51 in the handle member 11 having edges 52 that may be relatively close together. A slot through which the control finger passes may be defined between the edges 52, as shown in FIG. 24.

In some exemplary embodiments, the rod may have shape memory. For example, when the rod is retracted into the handle element 11, as shown in FIG. 23, for example, the rod is configured in a shape which is different from the shape that it has when it is engaged in the support 13, as shown in FIG. 25.

In the exemplary embodiment depicted in FIGS. 22 through 25, the rod of the moving element 42 is naturally curved so that when it is engaged in the support 13, which is more flexible than the rod, it causes the support 13 to be deformed, tending to take up its own curved shape. When the rod of the moving element 42 is retracted into the handle member 11, it deforms, for example, elastically, to take up a substantially rectilinear shape, since the handle member 11 is more rigid than the rod.

Figure 27:
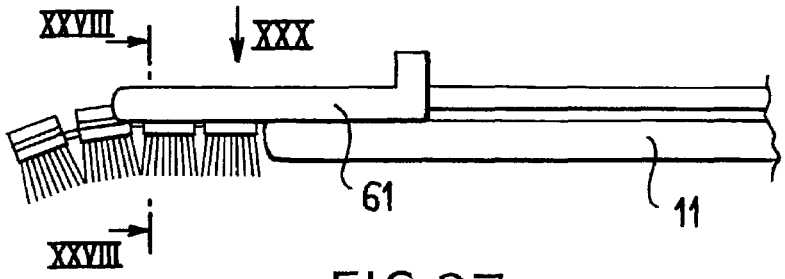
FIG. 27 is a partial schematic view of the embodiment of applicator of FIG. 26 in another configuration.
Figure 28:
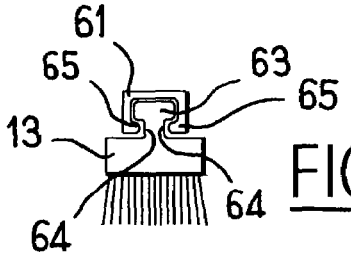
FIG. 28 is section view along line XXVIII-XXVIII of FIG. 27.
Figure 29:
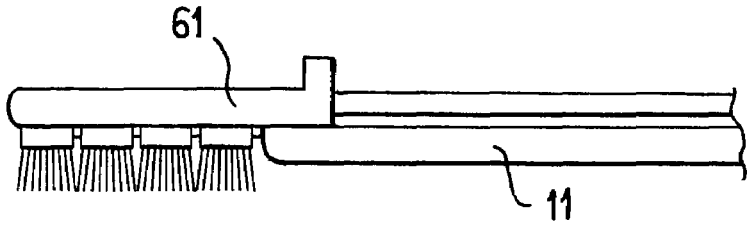
FIG. 29 is a partial schematic view of the embodiment of applicator of FIG. 26 in a further configuration.
Figure 30:
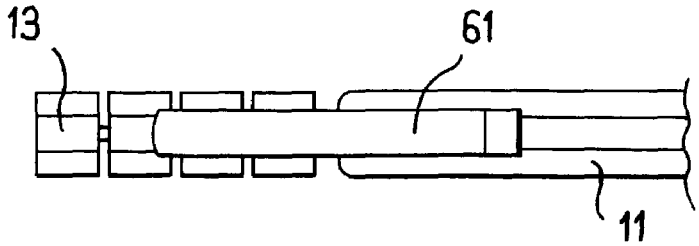
FIG. 30 is a partial schematic view along arrow XXX of FIG. 27.

The moving element 42 may be configured in shapes other than those shown in FIGS. 22 through 25. For example, FIGS. 26 through 30 depict an exemplary embodiment of an applicator 60 in which the moving element is in the form of a slider 61 configured to slide on the handle member 11, and is configured to engage the support 13 to change its shape. For example, the support 13 may include a rib 63 defining two opposing grooves 64 in which rims 65 of the slider 61 may engage. When the slider 61 is moved toward the applicator element, its rims 65 engage in the grooves 64, and the support 13 becomes progressively substantially parallel to the slider 61, as shown in FIGS. 27 and 29.

Figure 31:
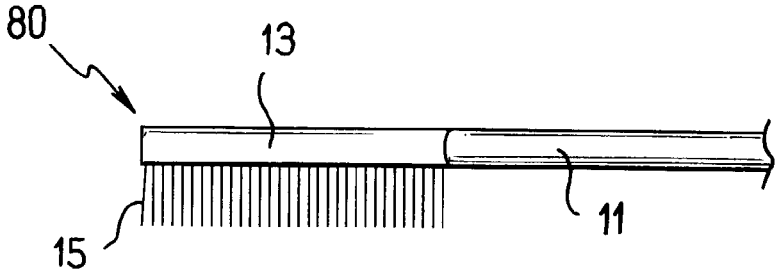
FIG. 31 is a partial schematic view of another embodiment of an applicator of a device for applying a substance to keratinous fibers.
Figure 32:
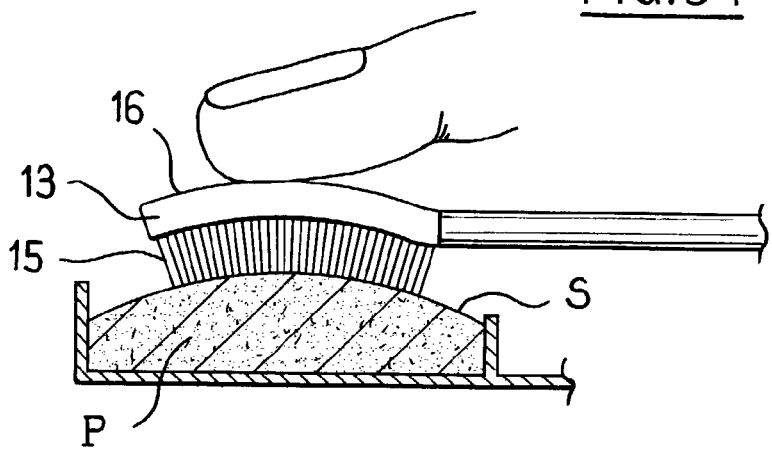
FIG. 32 is a partial schematic view of the embodiment of an applicator of FIG. 31 including a schematic section view of an embodiment of a cake of substance.

Some exemplary embodiments of the support 13 may be formed of, for example, an elastically deformable material (e.g., a thermoplastic material) so that they do not have a deformation zone at a predetermined axial location along the support 13. For example, FIG. 31 depicts an exemplary embodiment of an applicator 80 that may include a support 13 formed of an elastically deformable material having, for example, a substantially constant outside cross-section. The user can press against the face 16 of the support 13 opposite from the bristles 15 so as to shape the applicator element to substantially match the shape of the free surface S of the substance P, as shown in FIG. 32.

Figure 33:
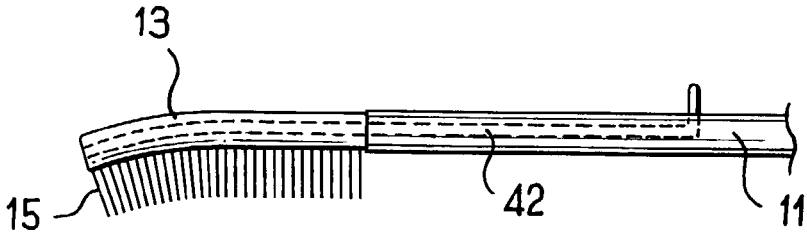
FIG. 33 is a partial schematic view of a further embodiment of an applicator of a device for applying a substance to keratinous fibers.
Figure 34:
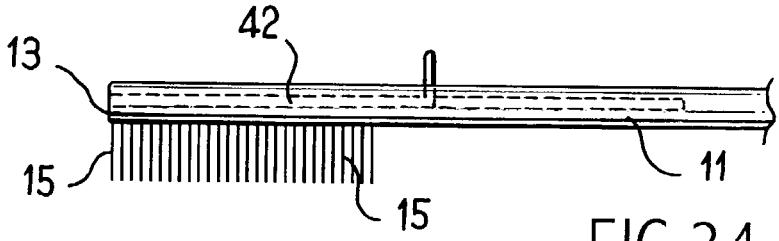
FIG. 34 is a partial schematic view of the embodiment of applicator of FIG. 34 in another configuration.

The support 13 may also be deformed, for example, by a moving element, as shown in FIGS. 33 and 34. According to some exemplary embodiments, the moving element 42 may include a rod that has a substantially rectilinear shape when at rest. The support 13 may have a shape that is not rectilinear when it is at rest, and engaging the rod in the support 13 may change the shape of the support 13, causing it to go from a substantially curvilinear configuration to a substantially rectilinear configuration, as shown in FIG. 34.

Figure 35:
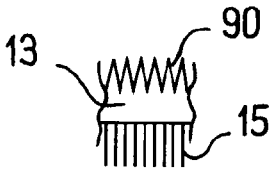
FIG. 35 is a partial schematic view of a portion of another embodiment of an applicator for a device for applying substance to keratinous fibers.

According to some exemplary embodiments, in addition to carrying bristles 15, the support 13 may include projecting elements that may be more rigid, as shown in FIG. 35. The projecting elements may be configured in the form of, for example, teeth 90 that may be integrally molded with the support 13 and may extend from a side of the support 13 opposite from the bristles 15.

Figure 36:
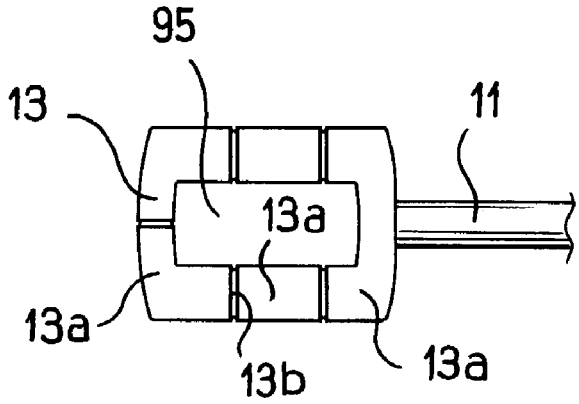
FIG. 36 is a partial schematic view of another embodiment of an applicator of a device for applying a substance to keratinous fibers.
Figure 37:
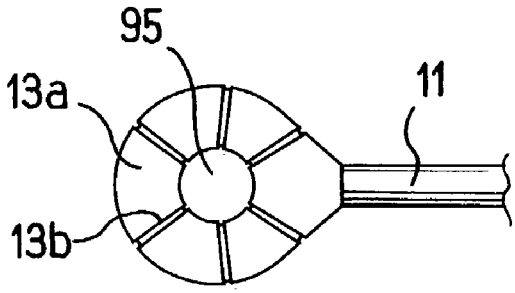
FIG. 37 is a partial schematic view of a further embodiment of an applicator of a device for applying a substance to keratinous fibers.
Figure 38:
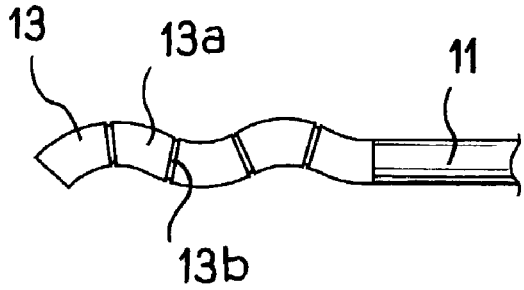
FIG. 38 is a partial schematic view of another embodiment of an applicator of a device for applying a substance to keratinous fibers.

According to some exemplary embodiments, the support 13 may include an opening 95, as shown in FIGS. 36 and 37. For example, the support 13 may be annular in shape around the opening 95 (e.g., in the form of a rectangular annulus, as shown in FIG. 36, or in the form of a circular annulus, as shown in FIG. 37). As viewed from above, for example, the support 13 may also be configured in a substantially non-rectilinear shape, as shown in FIG. 38. In the exemplary embodiment depicted in FIG. 38, the support 13 may have a generally undulating shape as viewed from above.

The device according to some exemplary embodiments of the invention may be used to apply cosmetic products and/or care products, such as make-up products, dermatological substances, and/or pharmaceutical compositions used for treating and/or changing the appearance and/or scent of keratinous fibers. However, in its broadest aspects, the present invention could be used to apply many other substances.

Furthermore, sizes of various structural parts and materials used to make the above-mentioned parts are illustrative and exemplary only, and one of ordinary skill in the art would recognize that these sizes and materials can be changed to produce different effects or desired characteristics.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. A method for applying a substance to keratinous fibers, the method comprising:

providing a device for applying a substance to keratinous fibers, the device comprising a cake of substance, and an applicator comprising a handle member defining a longitudinal axis, and an applicator element comprising a support comprising a first end and a second end opposite the first end, the first end being closer to the handle member than the second end, and a plurality of bristles extending from at least one side of the support between the first end and the second end, wherein the support is configured to be flexed so as to deform about at least one axis that is substantially perpendicular to the longitudinal axis of the handle member;

loading a portion of the substance onto the applicator element;

changing the shape of the support; and applying at least some of the substance to the keratinous fibers.

2. The method of claim 1, wherein changing the shape of the support comprises bending the support.

3. The method of claim 1, wherein the substance comprises a cosmetic product.

4. The method of claim 3, wherein the substance comprises mascara and the keratinous fibers comprise at least one of eyelashes and eyebrows.

5. A method of applying a substance to keratinous fibers, the method comprising:

providing a device for applying a substance to keratinous fibers, the device comprising a cake of substance, and an applicator comprising a handle member defining a longitudinal axis, and an applicator element comprising a support comprising a first end and a second end opposite the first end, the first end being closer to the handle member than the second end, and a plurality of bristles extending from at least one side of the support between the first end and the second end, wherein the support is configured to be flexed so as to deform about at least one axis that is substantially perpendicular to the longitudinal axis of the handle member;

making up the keratinous fibers using the device;

changing the shape of the applicator element; and continuing the making up of the keratinous fibers after the shape change.

6. The method of claim 5, wherein the keratinous fibers comprise at least one of eyelashes and eyebrows.

7. A method of applying a substance to keratinous fibers, the method comprising:

providing a cake of substance and an applicator element comprising a deformable support and a plurality of bristles;

loading the applicator element with a portion of the substance of the cake;

changing the shape defined by ends of at least some of the bristles of the applicator element by deforming the deformable support at least in a direction defined by a length of at least some of the bristles; and applying the substance to the keratinous fibers after the shape change.

8. The method of claim 7, wherein the keratinous fibers comprise at least one of eyelashes and eyebrows.

9. The method of claim 7, wherein loading the applicator element comprises pressing a finger on the deformable support of the applicator element so as to cause the shape defined by the ends of at least some of the bristles to substantially correspond to the shape of the cake of substance.

10. The method of claim 7, wherein changing the shape defined by the ends of at least some of the bristles occurs after the bristles are loaded with substance, and wherein the method further comprises releasing a deformation force applied to the deformable support such that the shape defined by the ends of at least some of the bristles returns elastically to an initial shape.

11. The method of claim 7, wherein the applicator element comprises a moving element, and changing the shape defined by the ends of at least some of the bristles occurs after the applicator element is loaded with substance by moving the moving element.

12. The method of claim 7, wherein the shape changing occurs without deforming a handle member associated with the applicator element.

13. A method for applying a substance to keratinous fibers, the method comprising:

providing a device for applying a substance to keratinous fibers, the device comprising a cake of substance, and an applicator comprising a handle member, and an applicator element comprising a support, and a plurality of bristles extending from the support, at least some of the plurality of bristles having ends defining a shape, wherein the support is configured to be flexed at least in a direction defined by a length of at least some of the bristles such that the shape defined by the ends of at least some of the plurality of bristles changes upon flexing the support;

loading a portion of the substance onto the applicator element;

changing the shape defined by the ends of at least some of the bristles; and applying at least some of the substance to the keratinous fibers.

14. The method of claim 13, wherein changing the shape defined by the ends of at least some of the bristles comprises bending the support.

15. The method of claim 13, wherein the substance comprises a cosmetic product.

16. The method of claim 15, wherein the substance comprises mascara and the keratinous fibers comprise at least one of eyelashes and eyebrows.

17. A method of applying a substance to keratinous fibers, the method comprising:

providing a device for applying a substance to keratinous fibers, the device comprising a cake of substance, and an applicator comprising a handle member, and an applicator element comprising a support, and a plurality of bristles extending from the support, at least some of the plurality of bristles having ends defining a shape, wherein the support is configured to be flexed at least in a direction defined by a length of at least some of the bristles such that the shape defined by the ends of at least some of the plurality of bristles changes upon flexing the support;

making up the keratinous fibers using the device;

changing the shape defined by the ends of at least some of the bristles; and continuing the making up of the keratinous fibers after the shape change.

18. The method of claim 17, wherein the keratinous fibers comprise at least one of eyelashes and eyebrows.

* * * * *

UNITED STATES PATENT AND TRADEMARK OFFICE

CERTIFICATE OF CORRECTION

PATENT NO. : 7,497,219 B2
APPLICATION NO. : 10/367751
DATED : March 3, 2009
INVENTOR(S) : Jean-Louis H. Gueret It is certified that error appears in the above-identified patent and that said Letters Patent is hereby corrected as shown below:

On the title page, in item (75), please replace "J an-Louis" with --Jean-Louis--.

Signed and Sealed this

Twenty-ninth Day of September, 2009

David J. Kappos

David J. Kappos
*Director of the United States Patent and Trademark Office*